US006155818A

United States Patent [19]

Joshi et al.

[11] Patent Number: 6,155,818

[45] Date of Patent: Dec. 5, 2000

[54] OXY-BURNER HAVING A BACK-UP FIRING SYSTEM AND METHOD OF OPERATION

[75] Inventors: Mahendra L. Joshi, Darien; Olivier Charon, Chicago; Harley A. Borders, Lombard; Roman E. Grosman, Lisle, all of Ill.

[73] Assignees: L'Air Liquide, Societe Anonyme pour l'Etude et, l'Exploitation des Procedes, Georges Claude, Paris, France; Air Liquide America Corporation, Houston, Tex.

[21] Appl. No.: 09/464,921

[22] Filed: Dec. 16, 1999

[51] Int. Cl.[7] ..... F23C 7/00

[52] U.S. Cl. ..... 431/12; 431/89; 431/6

[58] Field of Search ..... 431/6, 12, 62, 431/89, 90, 115, 159; 137/893

[56] References Cited

U.S. PATENT DOCUMENTS

| | | | |
|---|---|---|---|
| H19 | 2/1986 | Carlson | 431/12 |
| 3,817,685 | 6/1974 | Joannes | 431/116 |
| 4,130,388 | 12/1978 | Flanagan | 431/116 |
| 4,443,183 | 4/1984 | Shimizu et al. | 431/12 |
| 4,547,150 | 10/1985 | Vereecke | 431/12 |
| 4,568,268 | 2/1986 | Gerlach et al. | 431/90 |
| 4,673,348 | 6/1987 | Riley et al. | 431/115 |
| 4,708,638 | 11/1987 | Brazier et al. | 431/116 |
| 4,745,941 | 5/1988 | Nilsson | 137/114 |
| 4,874,310 | 10/1989 | Seemann et al. | 431/12 |
| 4,954,076 | 9/1990 | Fioravanti et al. | 431/116 |
| 5,145,361 | 9/1992 | Kurzinski | 432/19 |
| 5,516,279 | 5/1996 | Yap | 431/175 |
| 5,518,395 | 5/1996 | Maughan | 431/8 |
| 5,567,141 | 10/1996 | Joshi et al. | 431/8 |
| 5,865,206 | 2/1999 | Steigman et al. | 137/7 |

*Primary Examiner*—Ira S. Lazarus
*Assistant Examiner*—Sara Clarke
*Attorney, Agent, or Firm*—Brinks Hofer Gilson & Lione

[57] ABSTRACT

An oxy-burner having a back-up firing system includes an oxidant conduit coupled to an oxidant injector nozzle. A primary oxygen line is coupled to the oxidant conduit and transports oxygen into the oxidant conduit. An auxiliary air ejector is coupled to the oxidant conduit and is configured to receive a motive fluid and to entrain ambient air and force the entrained air into the oxidant conduit. In operation, upon detecting a disruption in the primary oxygen supply, a motive fluid is supplied to the auxiliary air ejector. The motive fluid injected by the auxiliary air ejector entrains ambient air sufficient to either continue operation of the oxy-burner, or provide cooling air to the oxy-burner in the event that the burner is shut down. Upon restoring the primary oxygen supply, the back-up oxy-burner system can be deactivated and the oxy-burner return to standard operation.

20 Claims, 3 Drawing Sheets

OXY-BURNER HAVING A BACK-UP FIRING SYSTEM AND METHOD OF OPERATION

FIELD OF THE INVENTION

This invention relates, in general, to oxy-burner systems for simultaneously burning gaseous or liquid fuels in the presence of oxygen or oxygen-enriched air, and more particularly, to an oxy-burner and back-up firing system and method of operation for continuously operating the oxy-burner in the event of a disruption in the oxidant supply.

BACKGROUND OF THE INVENTION

Recently, burners have been developed that use oxygen or oxygen-enriched air to support combustion of a fuel in a burner known as an oxy-burner. Oxy-burners are compact and produce typically small flames with a high power output. In conventional heating and melting operations, several different types of fuels, such as natural gas, propane, coal gas, oil, and the like, can be used to obtain the high temperatures necessary to change the furnace charge from a solid to a pre-heated or molten state. In an oxy-burner, substantially pure oxygen, generally 80% oxygen or higher, is mixed with the fuel gas to produce extremely high flame temperatures. The high flame temperatures can rapidly heat or melt the furnace charge. Rapid melting is particularly beneficial in the manufacture of iron and steel. Additionally, oxy-burners are widely used in various metallurgical plants to reduce melting time and the total energy necessary to bring the metallurgical charge to a molten state.

Operation of an oxy-burner necessarily requires that a supply of oxygen is readily available to operate the burner. Typically, an on-site oxy generation plant, such as vacuum or pressure swing absorption units, or cryogenic air separation units are maintained in proximity to the oxy-burner. During burner operation, a continuous, uninterrupted supply of oxygen is necessary to avoid production losses and potential damage to the burner system if the supply of oxygen is interrupted. In certain non-water cooled oxy-burners, metallic parts can be damaged by furnace radiation unless the burner is pulled out of service, or cooled with auxiliary cooling air or water that is circulated to the burner nozzles.

To limit the possibility of production losses and burner damage, metallurgical plant operations typically provide a liquid oxygen supply tank to serve as a back-up oxygen supply. The liquid oxygen supply requires continuous replenishing to compensate for evaporation losses. Because of the relatively high cost of maintaining a liquid oxygen back-up supply, many metallurgical operations fail to store sufficient back-up oxygen to meet their entire needs during a disruption in the primary oxygen supply. Additionally, because of space limitations, back-up oxygen supply tanks may not hold enough oxygen to operate the burner for the required operation.

An alternative to on-site oxygen storage is to provide a back-up air supply system. In the event of a disruption in the oxygen supply, the oxy-burner can be operated as an air-fuel burner. Although the operation of an oxy-burner with a back-up air supply system maintains burner operation, the air must be free of lubricating grease, oils, and other contamination to avoid damaging the oxy-burner. The requirement for an extremely clean back-up air supply limits the back-up air supply system to the use of dedicated air lines and delivery equipment. The need to use dedicated equipment, such as compressors, blowers, piping performance, flow controls, and the like increases the overall capital cost of the furnace combustion system. Further, the dedicated air supply equipment requires that a relatively large amount of space be available for the installation of equipment that is used only intermittently. Moreover, after operating an oxy-burner from a back-up air system, the oxy-burner must be removed from the furnace and thoroughly cleaned to ensure that the burner has not been contaminated by air operation.

Although oxy-burners offer a convenient means of obtaining high flame temperatures for operation of metallurgical furnaces, economic operation of the furnace requires a reliable and economic method of operation in the event of a loss in the primary oxygen supply. The economic and safety considerations in the operation of a metallurgical furnace require that a back-up firing system be safe, fast, functional and cost effective. Accordingly, a need exists for an improved back-up oxy-burner firing system and method of operation.

BRIEF SUMMARY OF THE INVENTION

The present invention is for an oxy-burner having a back-up firing system and method of operation. The back-up firing system can be used for supplying air for burner operation or for cooling burner components in the event of a disruption in the primary oxygen supply. The burner includes a fuel conduit coupled to a fuel injector nozzle, and an oxidant conduit having an oxidant injector nozzle either adjacent to or circumferential with the fuel conduit. An auxiliary air ejector is coupled to the oxidant conduit. The auxiliary air ejector is configured to receive a motive fluid and to entrain air and to force the entrained air into the oxidant conduit.

The back-up oxy-burner firing system can use a variety of motive fluids, such as oxygen, nitrogen, steam, compressed air, and the like. Additionally, the auxiliary air ejector can be coupled to the oxidant conduit by a quick disconnect fitting. Accordingly, the auxiliary air ejector can be rapidly connected to the oxy-burner in the event of a loss in the primary oxygen supply.

In the event of a disruption in the primary oxygen supply, the auxiliary air ejector can be put into operation to entrain ambient air and force the entrained ambient air into the oxidant conduit. The auxiliary air ejector is designed to receive motive fluid at a pressure of about 50 psig to about 150 psig, and to provide about 5 standard cubic feet per hour to about 20 standard cubic feet per hour of air for every standard cubic foot per hour of motive fluid. In operation, the auxiliary air ejector can provide an air flow rate of about 300 standard cubic feet per hour to about 500 standard cubic feet per hour. The flow rate of air is obtained with a volumetric flow rate motive fluid that is about 10 to about 40% of the primary oxygen flow rate that is used by the oxy-burner during normal operation.

DETAILED DESCRIPTION OF PREFERRED EMBODIMENTS.

The oxy-burner with a back-up firing system and method of operation of the present invention provide an economical and effective means for rapidly dealing with a potentially catastrophic loss of the primary oxygen supply to an oxy-burner. Since the back-up firing system and method of the invention entrains ambient air and forces the air into the oxy-burner, extensive equipment and facilities are not required for emergency burner operation and cooling. As described below, the ejector system of the invention can be operated with a number of motive fluids that are readily available at a metallurgical plant. Additionally, the air ejector operates with a motive fluid supplied at a pressure and flow rate that is commonly available on-site at metallurgical operating facilities. Accordingly, upon detection of a failure in the primary oxygen supply, the back-up oxy-firing system can be quickly brought on line and economically operated to either continue furnace operations, or alternatively, to supply cooling air to burner components.

Figure 1:
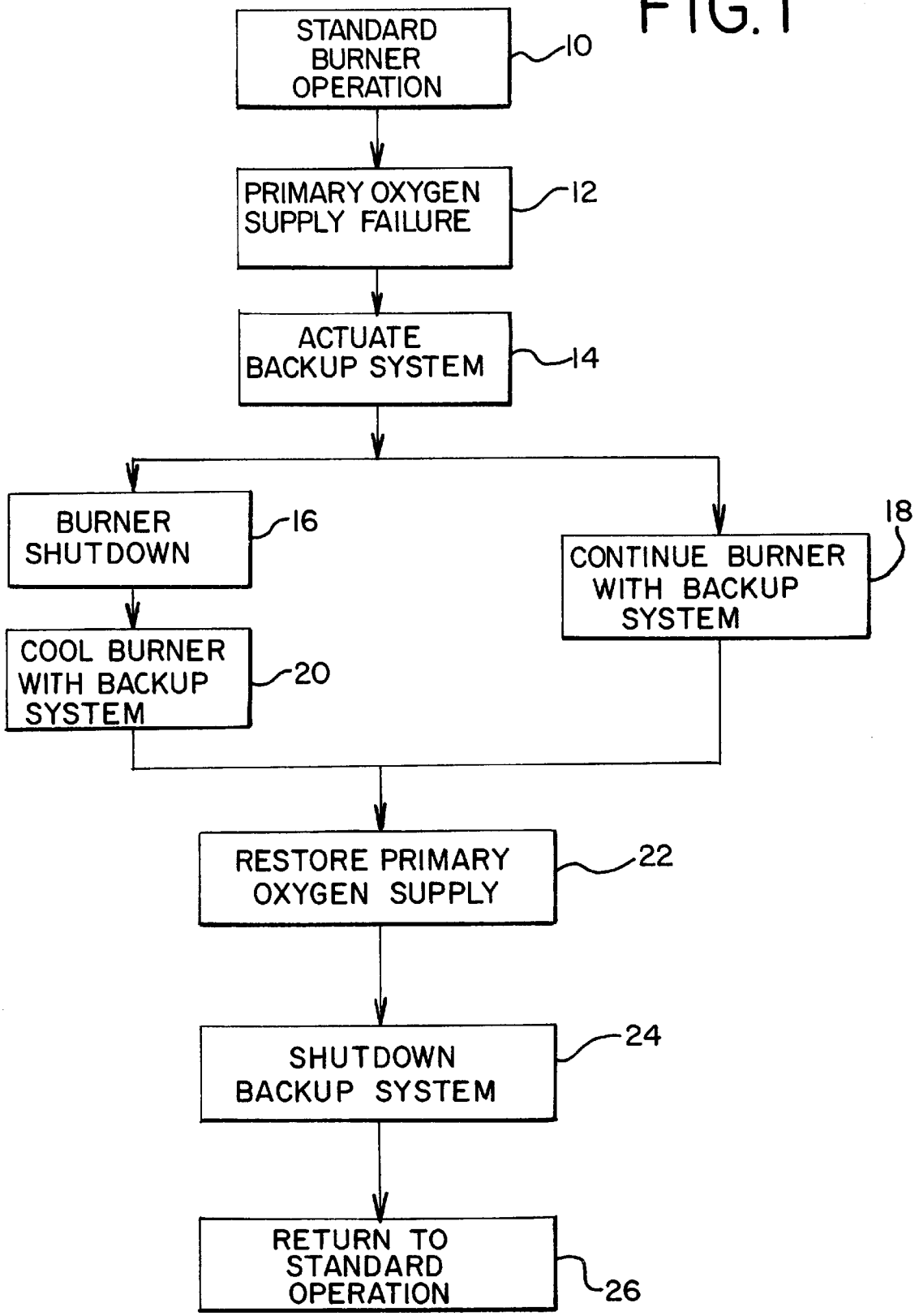
FIG. 1 is a schematic diagram of a method for operating a back-up oxy-burner firing system in accordance with the invention.

A method for operating a back-up oxy-burner firing system is generally illustrated in the flow diagram of FIG. 1. A standard burner operation of a metallurgical furnace is indicated at step 10. Upon detection of a primary oxygen supply failure at step 12, the back-up oxy-burner system is activated at step 14. In accordance with the invention, the burner can be either shut down at step 16, or alternatively, the operator can continue burner operation with the back-up system at step 18. If the burner is shut down at step 16, cooling fluid is supplied by the back-up system at step 20. Upon restoring the primary oxygen supply at step 22, the back-up system is shut down at step 24 and the burner is returned to standard operation at step 26.

Those skilled in the art will appreciate that a varying degree of automation can be incorporated to activate and de-activate the back-up system and to return the burner to standard operation. For example, flow sensors, temperature detectors, and solenoid valves can be integrated in a control system for automatic activation and de-activation of the back-up system. Alternatively, the back-up system can be manually activated by installing an air ejector in a receptacle designed to receive the air ejector using a standard quick disconnect fitting. This method is particularly advantageous if the metallurgical plant maintains a back-up liquid oxygen or nitrogen tank. The burner can then be manually activated to continue combustion operations, or alternatively, cooled by the flow of air and motive fluids from the back-up system.

Figure 2:
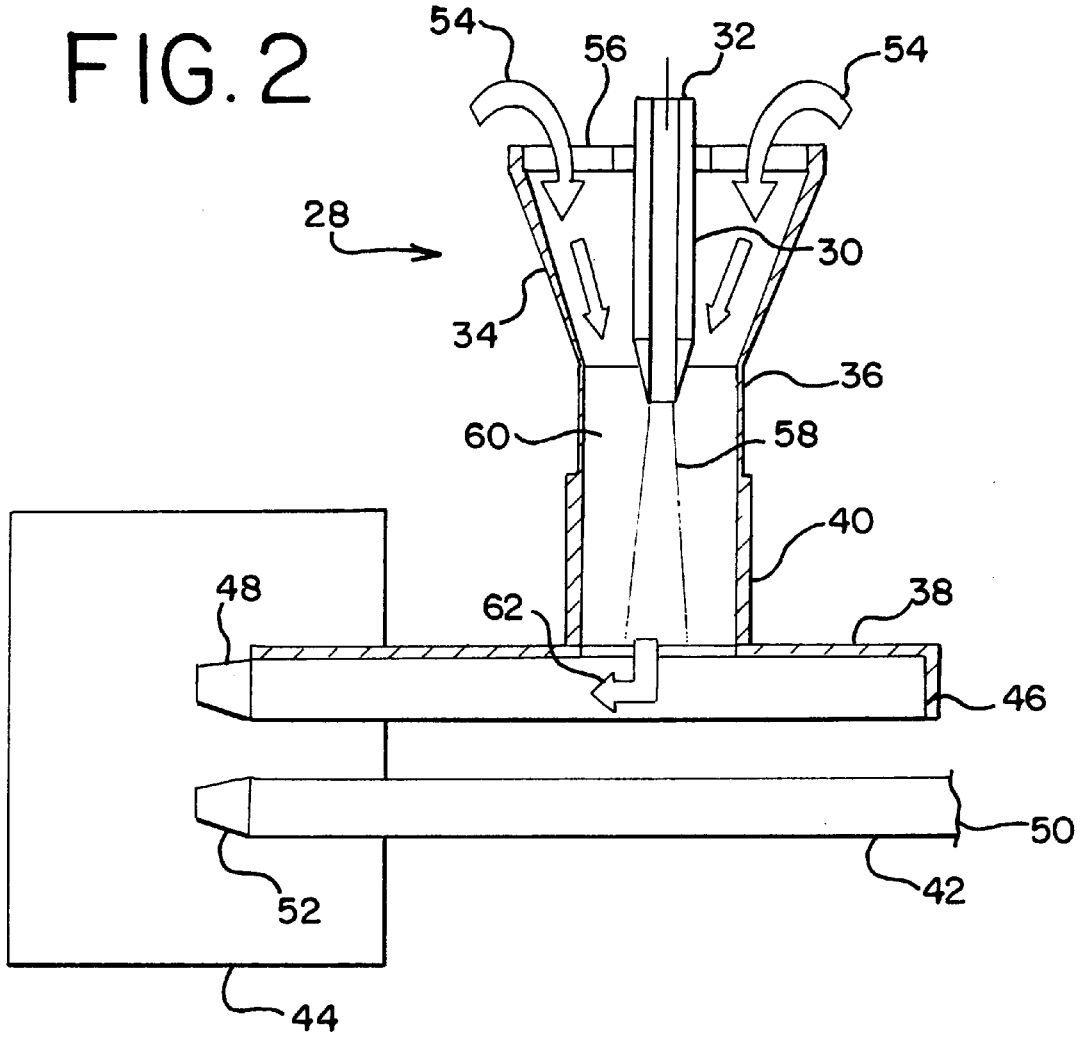
FIG. 2 illustrates, in cross-section, a back-up oxy-burner firing system in accordance with one embodiment of the invention.

A cross-sectional view of a back-up oxy-burner firing system in accordance with one embodiment of the invention is illustrated in FIG. 2. A motive fluid, such as liquid oxygen, nitrogen, steam, air, and the like is provided through a fluid nozzle 30 at an inlet 32. Auxiliary air ejector 28 includes a funnel portion 34 coupled to a throat region 36. Throat region 36 is coupled to an oxidant conduit 38 by a coupling 40. Coupling 40 can be any of a variety of standard tube couplings, and in particular, coupling 40 can be a quick disconnect fitting.

In the embodiment illustrated in FIG. 2, oxidant conduit 38 is positioned in proximity to a fuel conduit 42. Both oxidant conduit 38 and fuel conduit 42 are inserted into a burner block 44. In normal operation, primary oxygen flows through oxidant conduit 38 from an inlet region 46 and is injected into burner block 44 at an oxidant nozzle 48. Correspondingly, fuel enters an inlet region 50 of fuel conduit 42 and is injected into burner block 44 at fuel nozzle 52.

In operation, auxiliary air ejector 28 entrains ambient air through an annular opening 56 and channels the ambient air to throat region 36. A high velocity motive fuel jet exiting fluid nozzle 30 creates a negative pressure region 60 in throat region 36. The negative pressure draws ambient air 54 through annular opening 56 and combines with motive fluid jet 58 to form a gas mixture 62. Gas mixture 62 is forced into oxidant conduit 38 and is injected into burner block 44 at oxidant nozzle 48.

The ambient air entrainment process is put in action by slow moving ambient air molecules colliding with the fast moving motive fluid molecules. The bumping of slow-moving air molecules with the fast moving fluid molecules creates a bulk movement of the overall mixture. The net effect is a reduction in pressure in negative pressure region 60 (the venturi effect) that results in continuous entrainment of ambient air. Auxiliary air ejector 28 effectively "pumps" ambient air into oxy-conduit 38 by the pressure difference between annular opening 56 and throat region 36.

To create the ambient air entrainment process, motive fluid is preferably injected at a high velocity into throat region 36. Preferably, the motive fluid, such as oxygen, nitrogen, compressed air, and the like is supplied at inlet 32 of fluid nozzle 30 at a pressure of about 50 psig to about 150 psig. Alternatively, the ambient air entrainment process can be carried out by supplying clean, dry steam at a pressure of about 90 psig to about 100 psig. Additionally, sufficient ambient air can be entrained by auxiliary air ejector 28 with a motive fluid flow rate of about 300 scfh to about 500 scfh. Those skilled in the art will appreciate that the particular values of supply pressure and motive fluid flow rate will depend upon factors, such as the particular motive fluid, the geometric characteristics of the auxiliary air ejector, the required firing rate of the particular furnace, required flame temperatures, and the like.

In a preferred embodiment of the invention, throat region 36 has an overall length of about 6 to about 12 times the diameter of throat region 36. The length of throat region 36 is particularly selected to take advantage of motive fluid 58 for the creation of vacuum pressure at negative pressure region 60. Additionally, the length requirements of throat region 36 provide for a fully developed motive fluid jet upon injection into oxidant conduit 38. Further, to maintain a high rate of ambient air flow, the outside diameter of annular opening 56 is preferably about 2 to about 6 times the diameter of throat region 36.

The back-up oxy-firing system of the invention can provide combustion air in a theoretically correct stoichiometric ratio for operation of commercial oxy-burners. The entrainment efficiency of ambient air can be measured by determining an amplification ratio. This is the ratio of the amount of entrained air for one cubic foot of motive fluid that is injected by auxiliary air ejector 28. In operation, auxiliary air ejector 28 will have an amplification ratio of about 5 to about 20 depending upon the particular motive fluid and the supply pressure. For example, using liquid oxygen as a motive fluid supplied at a pressure of about 100 psig, an amplification ratio of about 10 to about 20 can be obtained.

Figure 3:
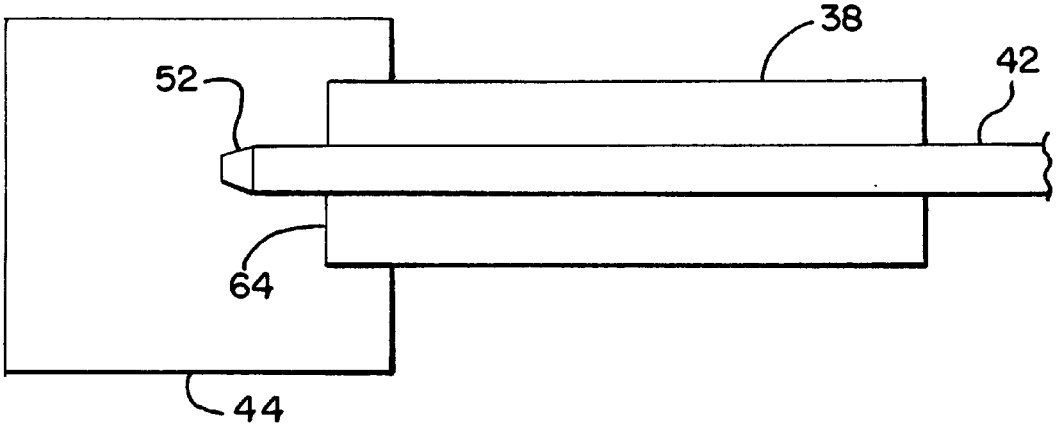
FIG. 3 illustrates, in cross-section, an alternative conduit configuration.

Those skilled in the art will appreciate that various types of burner injector arrangements are commonly used in commercial oxy-burners. While FIG. 2 illustrates an oxy-burner having a dedicated pipe for oxidants and a dedicated pipe for fuel, an alternative design is illustrated in FIG. 3. Fuel conduit 42 is partially surrounded by oxidant conduit 38. In burner block 44, oxidants are injected from an annular nozzle 64 and fuel is injected from fuel nozzle 52. Auxiliary air ejector 28 can be attached to oxidant conduit 38 in a manner similar to that described above. Those skilled in the art will appreciate that different injector designs in an oxy-burner can be dictated by parameters, such as firing capacity, flame stability, flame temperature, and the like. The back-up oxy-burner firing system of the invention can be operated with any type of injector configuration. In addition to those illustrated in FIGS. 2 and 3, the lock-up firing system can be used with other configurations, such as multiple injection nozzle configurations, and the like.

An important aspect of the invention is the ability to operate an oxy-burner using auxiliary air ejector 28, while supplying motive fluid at a fraction of the primary oxygen flow required for standard operations. In many oxy-burners, it is possible to fire up to about 40% of the rated oxy-fuel firing capacity using ambient combustion air for air-fuel combustion. The capacity limitation is a result of reduced flame stability caused by the higher flow velocities of the entrained ambient air through the oxidant nozzle. The higher flow rates cause the flame in burner block 44 to blow off, which limits the firing capacity for tube-in-tube oxy-burners, such as illustrated in FIG. 3. In oxy-burner designs having multiple fuel and oxidant conduits, firing capacities of greater than about 40% can be obtained using ambient air. The greater firing capacity is due, in part, to the much lower average fuel and combustion air velocities, which increase flame stability. Operation of an oxy-burner using the back-up system of the invention can produce a firing rate of up to about 50 to about 60% of the normal oxy-fuel firing rate. This high firing rate is obtained by using liquid oxygen or oxygen-enriched air as the motive fluid.

In addition to higher firing rates, the back-up system of the invention can be operated with as little as about 18% by volume of the primary oxygen flow needed for standard operation. Correspondingly, where nitrogen is used as the motive fluid, the motive fluid flow rate requirement is equivalent to about 25% by volume of the primary oxygen flow rate during standard operations. Importantly, while using liquid oxygen, nitrogen, or other motive fluid, the furnace can be fired by the oxy-burner without interruption. Regardless of the particular motive fluid used, the back-up oxy-burner firing system of the invention offers a fast, safe, reliable, and cost effective method of operating an oxy-burner during a primary oxygen failure. The choice of a particular motive fluid will depend on numerous parameters, such as price, availability, plant facilities, and storage availability, and the like. Examples of operating parameters for a back-up oxy-burner firing system of the invention using oxygen or nitrogen as a motive fluid are shown in Table I.

TABLE I

| | Ejector Performance Parameters | | | | | | | |
|---|---|---|---|---|---|---|---|---|
| Motive Fluid | Burner Firing Rate (MM Btu/Hr) | NG Flow Rate (scfh) | Primary Oxygen Flow Rate (scfh) | Entrained Combustion Air Flow Requirement (scfh) | Motive Fluid Supply Pressure (psig) | Motive Fluid Flow Rate (scfh) | Oxygen Conc. In Oxidant Mixture | Amp. Ratio of the Ejector |
| Oxygen | 2.00 | 2,000 | 4,000 | 15,500 | 100 | 750 | 0.246 | 20 |
| Nitrogen | 2.00 | 2,000 | 4,000 | 22,000 | 100 | 1,100 | 0.20 | 20 |

The performance parameters set forth in Table I are for a 2 MMBtuHr pipe-in-pipe oxy-burner. The data in Table I show that a back-up oxy-burner can be operated using the system of the invention with oxygen as a motive fluid at a flow rate of about 18% by volume of the primary oxygen flow rate. The total combustion gasses injected by the oxy-burner have an enrichment level of about 0.246%. Correspondingly, where nitrogen is used as a motive fluid, the flow rate requirement is equivalent to about 25% of the primary oxygen flow rate. With the use of nitrogen, the overall oxygen concentration of the oxidant gas is about 0.20%. In many cases, nitrogen operation is sufficient to entrain necessary combustion air for operation of an oxy-burner in the event of a primary oxygen failure. The operation of the back-up oxy-burner firing system of the invention using either oxygen or nitrogen permits operation of the oxy-burner without interruption of a high firing capacity.

Figure 4:
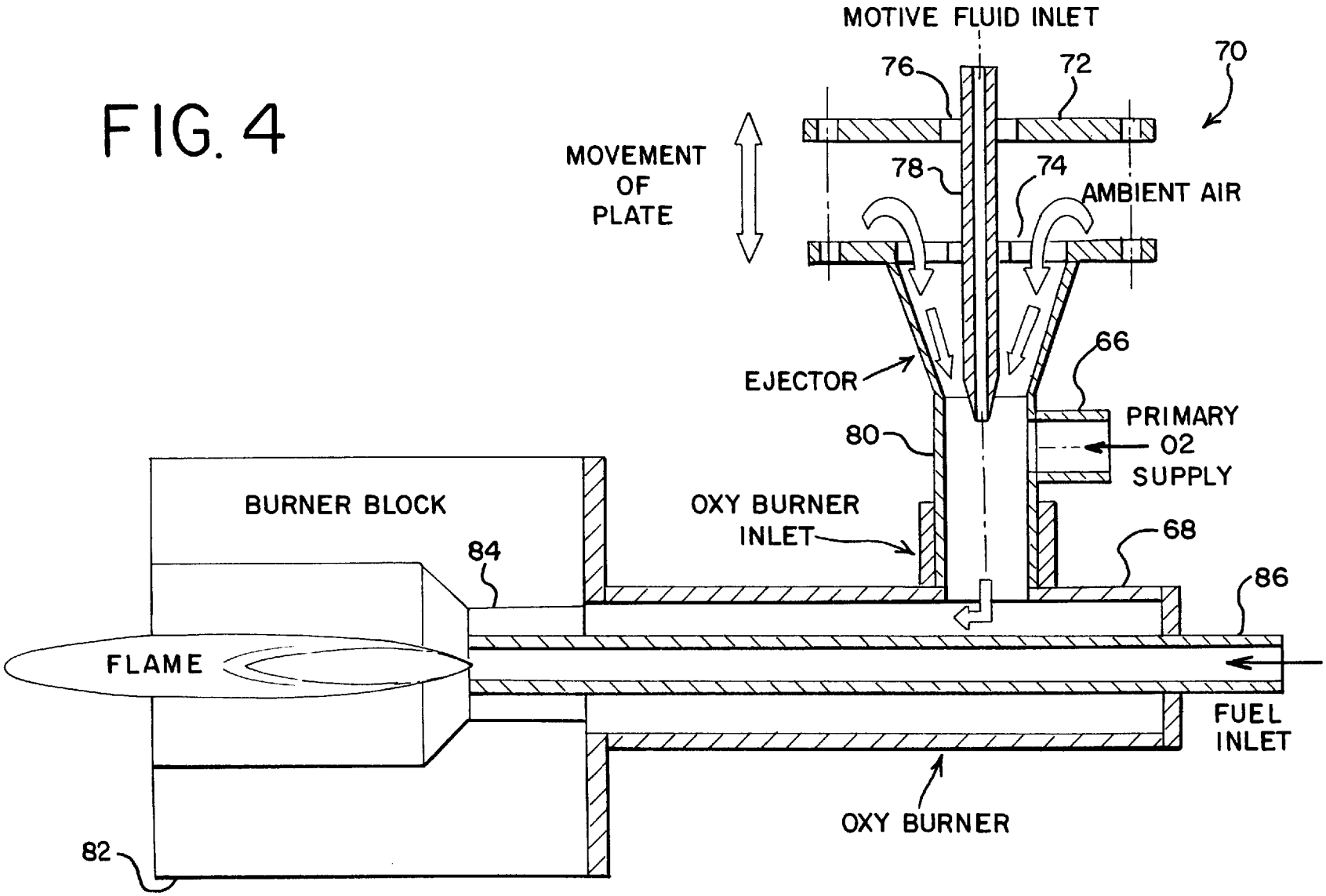
FIG. 4 illustrates, in cross-section, a back-up oxy-burner firing system arranged in accordance with another embodiment of the invention.

An alternative embodiment of the invention is illustrated, in cross-section, in FIG. 4. A primary oxygen supply line 66 is coupled to an annular oxidant conduit 68. An auxiliary air ejector 70 is coupled to primary oxygen supply line 66 by a standard coupling, which can be a quick disconnect fitting. A top plate 72 can be adjusted in a vertical direction for regulation of the quantity of ambient air entering an annular opening 74. A bearing 76 permits top plate 72 to vertically slide against motive fluid tube 78. Motive fluid is injected by fluid tube 78 into a throat region 80 of auxiliary air ejector 70. Entrained ambient air and motive fluid is forced into oxidant conduit 68 and injected into a burner block 82 at nozzle 84. Fuel is injected into burner block 82 through a fuel conduit 86.

For automated operation, auxiliary air ejector 70 can be equipped with a solenoid valve (not shown) to control charging of the motive fluid. Electrical circuitry (not shown) can be incorporated to activate the motive fluid supply when a primary oxygen failure is detected. Additionally, top plate 72 can be either manually or automatically activated to adjust the amount of ambient air entrainment during operation of auxiliary air ejector 70.

It is important to note that the embodiments of the invention illustrated in FIGS. 2–4 can be used to either continue operation of an oxy-burner, or alternatively, to provide cooling air to an oxy-burner that has been abruptly shut down. Supplying cooling air is crucial if the oxy-burner is self-cooled. Cooling air sufficient to prevent thermal damage to the oxy-burner can be provided by either auxiliary air ejector 28 or auxiliary air ejector 70 at a rate of about 300 scfh to about 500 scfh for each oxy-burner that is fitted with an auxiliary air ejector. In addition to providing cooling air the back-up oxy-burner system also provides necessary purge air to keep process gasses within the furnace and volatile particulate matter away from the burner nozzles. The injection of purge air during oxy-burner shut down can prevent chemical corrosion and oxidation of the burner nozzles by gaseous species present in the furnace.

Thus it is apparent that there has been described an oxy-burner having a back-up firing system and method of operation that fully provides the advantages set forth above. Those skilled in the art will recognize that numerous modifications can be made without departing from the spirit of the invention. For example, numerous geometric variations of the auxiliary air ejectors illustrated herein can be made to perform the function of supplying air for burner operation and for cooling. Accordingly, all such variations and modifications are within the scope of the appended claims and equivalents thereof.

What is claimed is:

1. An oxy-burner having a primary oxygen supply and a back-up firing system for supplying air for oxidation and for cooling to the oxy-burner in the event of a disruption in the primary oxygen supply, the oxy-burner comprising:

a fuel conduit coupled to a fuel injector nozzle;

an oxygen induction apparatus, including an oxidant conduit coupled to an oxidant injector nozzle and a primary oxygen line coupled to the oxidant conduit for transporting oxygen into the oxidant conduit; and an auxiliary air ejector coupled to the oxidant conduit, wherein the auxiliary air ejector is configured to receive a motive fluid and to entrain air and to force the entrained air into the oxidant conduit.

2. The oxy-burner of claim 1, wherein the motive fluid is selected from the group consisting of liquid oxygen, nitrogen, steam, and compressed air.

3. The oxy-burner of claim 1, wherein the oxygen conduit is configured to transport substantially pure oxygen.

4. The oxy-burner of claim 1, wherein the auxiliary air ejector is coupled to a primary oxygen inlet line by a coupling comprising a quick disconnect fitting.

5. The oxy-burner of claim 1, wherein the auxiliary air ejection comprises an inlet having a first diameter and a throat region having a second diameter, and wherein the first diameter is about 2 to about 4 times larger than the second diameter.

6. The oxy-burner of claim 5, wherein the auxiliary air ejector further comprises a mixing tube coupled to the throat, wherein the mixing tube is characterized by a length and by a diameter, and wherein the ratio of the length to the diameter is about 6 to about 12.

7. A method for supplying air for oxidation and for cooling to an oxy-burner having a primary oxygen supply in the event of a disruption in the primary oxygen supply, the method comprising:

providing an auxiliary air ejector coupled to an oxidant conduit, wherein the auxiliary air ejector is configured to receive a motive fluid and to entrain ambient air and to force the entrained ambient air into the oxidant conduit;

upon detecting a disruption in the primary oxygen supply supplying a motive fluid to the auxiliary air ejector; and flowing air into the oxy-burner.

8. The method of claim 7, wherein the step of supplying a motive fluid comprises supplying a fluid selected from the group consisting of liquid oxygen, nitrogen, steam and compressed air.

9. The method of claim 7, wherein the primary oxygen is supplied at a predetermined flow rate, and wherein the step of supplying a motive fluid comprises flowing the motive fluid at a flow rate of about 10 to about 40% by volume of the predetermined flow rate.

10. The method of claim 7, wherein the step of supplying a motive fluid comprises supplying motive fluid at a pressure of about 50 to about 150 psig.

11. The method of claim 7, wherein the steps of supplying a motive fluid and flowing air comprise flowing about 5 to about 20 scfh of air for every scfh of motive fluid.

12. The method of claim 7, wherein the step of flowing air comprises flowing air at a flow rate of about 300 scfh to about 500 scfh.

13. The method of claim 9, wherein the step of supplying a motive fluid comprises flowing oxygen at a flow rate of about 18% by volume of the predetermined flow rate.

14. The method of claim 7, wherein the step of supplying motive fluid comprises flowing nitrogen at a flow rate of about 27% by volume of the predetermined flow rate.

15. A method for supplying a fluid for oxidation and for cooling to an oxy-burner having a primary oxygen supply in the event of a disruption in the primary oxygen supply, the method comprising:

providing an auxiliary air system coupled to an oxidant conduit wherein the auxiliary air system is configured to receive a motive fluid and to entrain air and to force the entrained air into the oxidant conduit;

activating the auxiliary air system upon detecting a disruption in the primary oxygen supply; and flowing motive fluid and entrained air into the oxy-burner.

16. The method of claim 15, wherein the step of activating the auxiliary air system comprises the steps of:

supplying motive fluid at a pressure of about 50 to about 150 psig; and operating the oxy-burner using the entrained air and motive supplied by the auxiliary air system.

17. The method of claim 16, wherein the step of supplying motive fluid comprises supplying a fluid selected from the group consisting of liquid oxygen, nitrogen, steam, and compressed air.

18. The method of claim 17, wherein the primary oxygen is supplied at a predetermined flow rate, and wherein the step of supplying a motive fluid comprises supplying the motive fluid at a flow rate of about 10 to about 40% by volume of the predetermined flow rate.

19. The method of claim 15, wherein the step of activating the auxiliary air system comprises the steps of:

supplying a motive fluid selected from the group consisting of nitrogen and air;

discontinuing the operation of the oxy-burner; and cooling the oxy-burner using the entrained air and the motive fluid supplied by the auxiliary air system.

20. The method of claim 19, wherein the step of supplying a motive fluid comprises supplying motive fluid at a flow rate of about 300 scfh to about 500 scfh.

* * * * *

UNITED STATES PATENT AND TRADEMARK OFFICE

CERTIFICATE OF CORRECTION

PATENT NO. : 6,155,818

DATED : September 28, 1999

INVENTOR(S) : Watanabe et al.

It is certified that error appears in the above-identified patent and that said Letters Patent is hereby corrected as shown below:

On the title page:

Under Section "[73] Assignee:" after "Procedes" delete "," (comma);

and after "Tex." Insert --, American Air Liquide Inc., Walnut Creek, Cal. --.

Claim 7, Col. 7, l. 54, after "supply" insert -- , -- (comma).

Signed and Sealed this

Twenty-second Day of May, 2001

*Attest:*

Nicholas P. Godici

NICHOLAS P. GODICI

*Attesting Officer*

*Acting Director of the United States Patent and Trademark Office*